US009523555B2

(12) United States Patent
Pellegrini

(10) Patent No.: US 9,523,555 B2
(45) Date of Patent: Dec. 20, 2016

(54) HOLSTER WITH AN INNER ANTI-FRICTION SLEEVE

(71) Applicant: RADAR LEATHER DIVISION S.R.L., Fucecchio (Firenze) (IT)

(72) Inventor: Paolo Pellegrini, Fucecchio (IT)

(73) Assignee: RADAR LEATHER DIVISION S.R.L., Fucecchio (Firenze) (IT)

( * ) Notice: Subject to any disclaimer, the term of this patent is extended or adjusted under 35 U.S.C. 154(b) by 189 days.

(21) Appl. No.: 14/384,516

(22) PCT Filed: Mar. 18, 2013

(86) PCT No.: PCT/IB2013/052150
§ 371 (c)(1),
(2) Date: Sep. 11, 2014

(87) PCT Pub. No.: WO2013/140327
PCT Pub. Date: Sep. 26, 2013

(65) Prior Publication Data

US 2015/0041507 A1 Feb. 12, 2015

(30) Foreign Application Priority Data

Mar. 20, 2012 (IT) ..... FI20120019 U

(51) Int. Cl.

| | |
|---|---|
| ***F41C 33/02*** | (2006.01) |
| ***F41C 33/04*** | (2006.01) |
| ***B32B 9/02*** | (2006.01) |
| ***B32B 9/04*** | (2006.01) |
| ***B32B 5/02*** | (2006.01) |
| ***B32B 7/12*** | (2006.01) |

(52) U.S. Cl.
CPC ..... *F41C 33/0272* (2013.01); *F41C 33/0209* (2013.01)

(58) Field of Classification Search
CPC ..... F41C 33/02; F41C 33/04; B32B 9/02; B32B 9/04; B32B 5/02; B32B 7/12
See application file for complete search history.

(56) References Cited

U.S. PATENT DOCUMENTS

| | | | | |
|---|---|---|---|---|
| 3,797,715 A | | 3/1974 | Scialdone | |
| 5,129,562 A | | 7/1992 | Bianchi | |
| 5,630,535 A | * | 5/1997 | Valenti | A45F 5/02 224/191 |

(Continued)

FOREIGN PATENT DOCUMENTS

| | | |
|---|---|---|
| FR | 2715464 | 7/1995 |
| FR | 2836214 | 8/2003 |

OTHER PUBLICATIONS

International Search Report issued in PCT Application No. PCT/IB2013/052150.

(Continued)

*Primary Examiner* — Brian D Nash
(74) *Attorney, Agent, or Firm* — Lucas & Mercanti, LLP

(57) ABSTRACT

The present invention refers to the field of the accessories for firearms in use by police officers, armies, private surveillance staff, and in particular it refers to the field of the holsters for accommodating handguns. More in detail it concerns a new holster (1) with anti-friction properties thanks to an inner sleeve (3), preferably but not necessarily of the replaceable type.

10 Claims, 3 Drawing Sheets

(56) References Cited

U.S. PATENT DOCUMENTS

| | | | | |
|---|---|---|---|---|
| 5,855,305 | A | 1/1999 | Nichols | |
| 8,714,423 | B1 * | 5/2014 | Kincaid | F41C 33/0254 224/192 |
| 2002/0047029 | A1 * | 4/2002 | Liao | F41C 33/0209 224/244 |
| 2003/0226866 | A1 | 12/2003 | Har-Shen | |
| 2005/0279790 | A1 | 12/2005 | Lowe | |
| 2006/0156525 | A1 | 7/2006 | Jenkins et al. | |
| 2006/0226185 | A1 | 10/2006 | Har-Shen | |
| 2012/0061432 | A1 * | 3/2012 | Novak | F41C 33/0209 224/243 |
| 2012/0286005 | A1 * | 11/2012 | Farnlacher | F41C 33/0245 224/244 |
| 2013/0299543 | A1 * | 11/2013 | Rorick | F41C 33/0263 224/674 |
| 2014/0048572 | A1 * | 2/2014 | Yeates | F41C 33/0272 224/193 |

OTHER PUBLICATIONS

Written Opinion of International Searching Authority issued in counterpart PCT Application No. PCT/IB2013/052150.

* cited by examiner

HOLSTER WITH AN INNER ANTI-FRICTION SLEEVE

CROSS-REFERENCE TO RELATED APPLICATIONS

This application is a 371 of PCT/IB2013/052150, filed Mar. 18, 2013, which claims the benefit of Italian Patent Application No. FI2012U000019, filed Mar. 20, 2012, the contents of each of which are incorporated herein by reference.

FIELD OF THE INVENTION

The present invention refers to the field of the accessories for firearms in use by police officers, armies, private surveillance staff, and in particular it refers to the field of the holsters for accommodating handguns

BACKGROUND OF THE INVENTION

As known, the holsters for handguns must be designed no as to firmly hold the gun, not only in case of normal movements of the user, but also when more intense and critical efforts are performed, e.g. Running, facing a scuffle or fight etc. Nevertheless the user should always be allowed to easily and quickly extract the gun when needed. Referring specifically to the holsters made of a rigid plastic shell, nowadays universally used, the extraction can be sometimes not as quick as desired, and furthermore, the same holster, but more importantly the gun, can become worn and even damaged, due to the impacts and frictions that occur as a result of the mutual movement, considering the hardness of the rigid material with which the shell is made. The prior art, to the best of the applicant's knowledge, does not disclose any fully satisfactory answer to these problems.

SUMMARY OF THE INVENTION

The object of the present invention is therefore to provide a new configuration of a holster that successfully addresses the above mentioned problems.

This object is achieved with the holster having an inner anti-friction sleeve according to the invention, the essential features of which are defined by the first of the appended claims.

Other advantageous features of the holster according the invention are defined by the dependent claims.

BRIEF DESCRIPTION OF THE DRAWINGS

The characteristics and advantages of the holster having an inner anti-friction sleeve according to the invention will now become apparent from the following description of an embodiment thereof, made purely as an example and not limitative, with reference to the attached drawings in which.

DETAILED DESCRIPTION OF THE INVENTION

Referring to the above figures, the holster according to the invention comprises a hollow shell, generally indicated at 1, made of a thermoplastic rigid material suitable for the molding manufacturing process, such as PVC, according to the techniques already well known in the field. The shell 1 is adapted to accommodate a handgun, to be inserted within the same shell through an insertion end opening 1*a* from which, when the gun is arranged inside the holster, the grip projects outwards. The shell 1 comprises more precisely two substantially parallel side walls 1*b* joined by a rear rib 1*c* and by a front rib 1*d*. The front rib is the part along (and in proximity to) which the dorsal portions of the slide and of the barrel of the gun become arranged. The shell 1 is therefore elongated according to a longitudinal direction running parallel with the ribs from the insertion opening.

The side walls 1*b* are provide with workings (holes, shaping) necessary to equip the shell with the required accessories (devices for securing the holster to a waist belt, or to other pieces of clothing, safety and/or locking devices etc.), all in accordance with the known art and not specifically relevant to the present invention. A detailed description of such workings and of the design features thus obtained (in any case variable depending on the different characteristics and performances of the various types of holsters) is therefore here omitted.

According to a particularly advantageous aspect of the present invention, the inner face of the shell 1, along the front rib 1*c* and over at least part of the side walls 1*b* adjacent with the same front rib, is affected by a recess 2 that extends longitudinally between the insertion end opening 1*a* and the longitudinal end 1*e* opposed to the insertion end.

Figure 3:
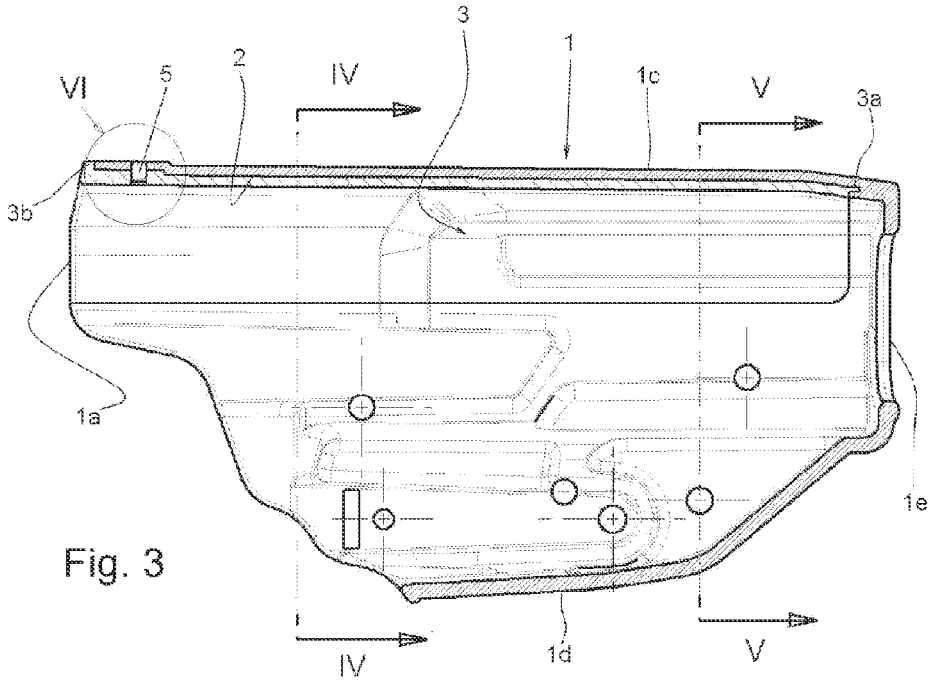
FIG. 3 is a longitudinal cross section view of the holster taken along line III-III of FIG. 2.
Figure 2:
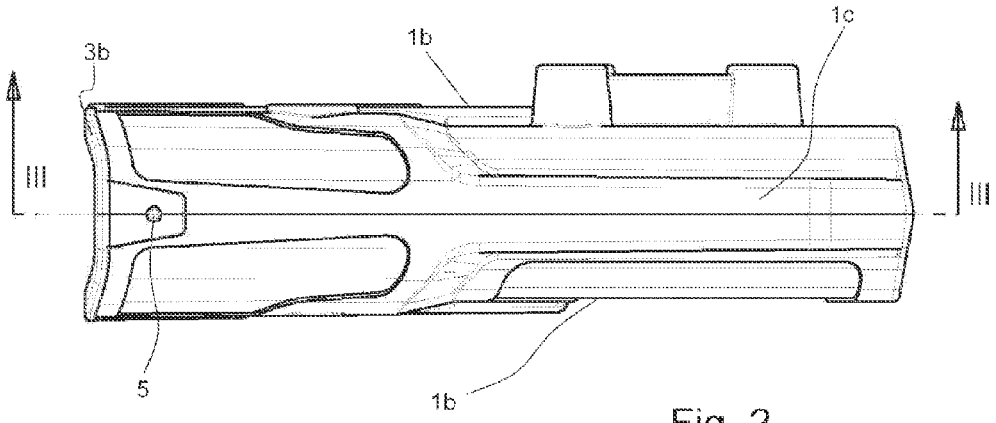
FIG. 2 is a front view of the holster with the inner sleeve in an inserted arrangement, i. e. in a use configuration.
Figure 5:
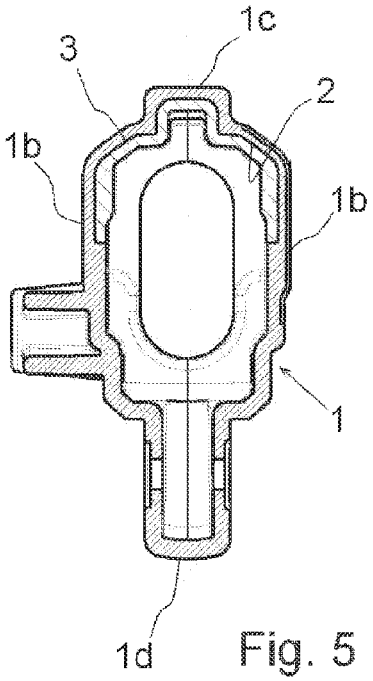
FIG. 4 and FIG. 5 are two transversal cross sections of the holster respectively taken along lines IV-IV and V-V of FIG. 3.
Figure 4:
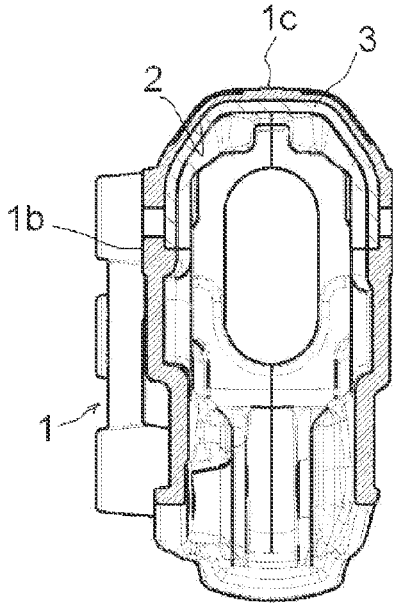

The recess 2 results in a local reduction of the thickness of the shell and has a substantially C-shaped cross section (the central leg of the C being the one corresponding to the front rib 1*c*), following in any case the variations in shape that the shell specifically takes on in its elongation (the two transversal cross sections of FIGS. 3 and 4 can e. g. be compared).

The recess 2 houses a sleeve 3, having a thickness such as to restore, when inserted, the thickness the wall would have had without the recess, so that the inner face of the shell has a continuous development as in traditional holster having the same shape but without any recess. The sleeve 3 and the recess 2 have therefore, respectively in positive and in negative impression, the same shape and size. Consequently, the sleeve 3 consists of an elongated gutter-like body, having a length that comes close to the longitudinal extension of the shell and a substantially C-shaped cross section. The sleeve 3 makes use of an anti-friction, self-lubricating material, typically polytetrafluoroethyiene (e.g. Teflon®) or other materials adapted to provide similar anti-friction and anti-adhesion performances (coefficient of static friction lower than 0.1) such as other polymeric materials (e.g. POM—polyoxymethylene) or even ceramic materials. Moreover, the sleeve can be entirely made of such material or have at least a surface treatment or lining film of the anti-friction material, over the inner surface (the surface that remains exposed for contact with the handgun inside the holster in the inserted configuration).

In order to make perfectly stable the engagement between the sleeve 3 and the shell 1 in the inserted arrangement, the recess 2 advantageously has, opposed to and spaced apart from the handgun insertion top end 1*a*, a longitudinal bottom end in the form of a step defining a sleeve-stop bottom face. A groove 2*a* is out in said bottom face and locks a correspondent longitudinal bottom end lip 3*a* formed by the sleeve 3, whereby the engagement between said groove and said lip prevents said sleeve from displacing in a plane orthogonal with the longitudinal direction.

At the handgun insertion and 1*a* a further stop to the insertion position of the sleeve is provided by a sideways rim 3*b* that projects over a transversal plane and is adapted to abut against said end 1*a*, possibly, as in the example, forming a step that accommodates the rim not to generate additional bulk in the longitudinal direction.

Figure 1:
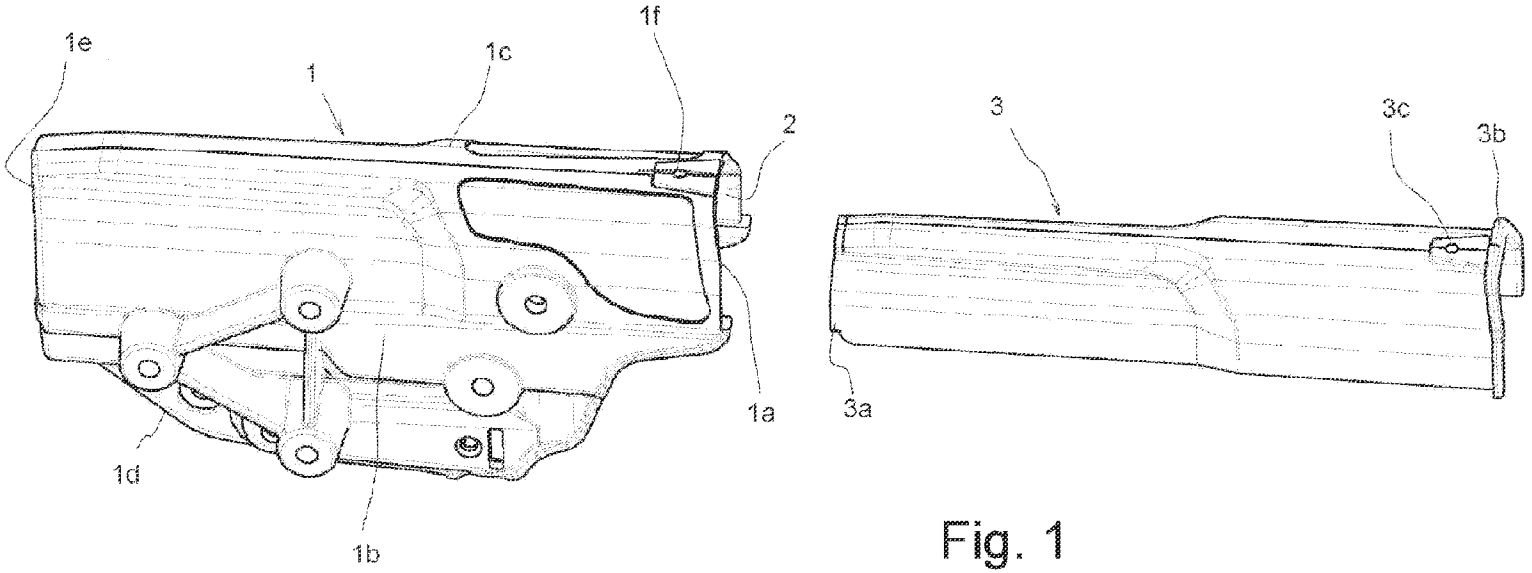
FIG. 1 is a perspective view of the holster in an exploded configuration, that is with the inner sleeve extracted from an outer shell.
Figure 6:
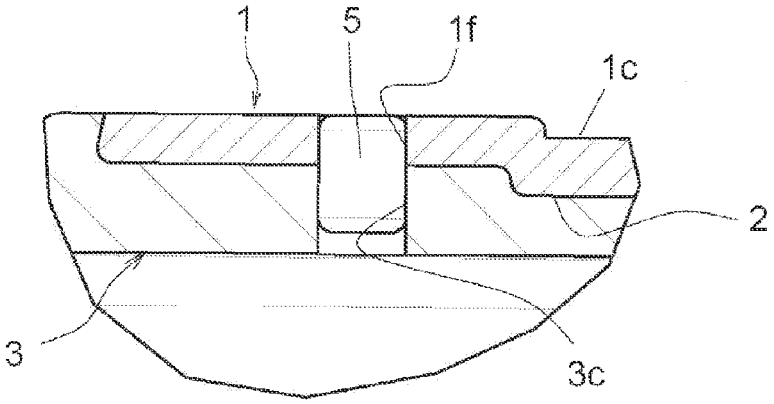
FIG. 6 shows in enlargement the detail inside the circle VI of FIG. 3.

Finally, the safety against the disengagement (extraction) of the sleeve 3 is advantageously increased by a locking peg 5 (see namely FIG. 6) that is forced in a sideways running through seat resulting from the mutual correspondence of two holes 1*f*, 3*c* formed in a suitable position respectively in the shell 1, in the region of the recess 2, and in the sleeve 3. In the depicted embodiment the seat is in proximity to the opening end 1*a*, on the front rib. In this way, exploiting the ease of access allowed by the opening, the peg 5 can be easily introduced with a pressure from the inside, by means of a common punch tool, and removed with an analogous pressure or percussion from the outside. The holes can also be formed in mutually matching bulging portions of the shell and of the sleeve (visible in particular in FIG. 1), the engagement between the bulging portion offering a further longitudinal stop action and a constraint against a rotation of the sleeve with respect to an axis along the longitudinal direction.

It is indeed the removal of the peg 5 that the sleeve 3 can be easily pulled out of the recess 2, for a replacement that may be required due to wear or other needs such as e.g. to restore the original play that keeps the gun absolutely firm and steady in its housing. This aspect of the present invention is of particular importance considering that possible swinging or vibrations of the gun are a source of undesired noises, that can jeopardized a successful result of critical police operations.

In the normal use of the holster the inserted sleeve will in any case make, due to the above mentioned anti-friction properties, the extraction of the handgun faster and easier, and the same applies to the subsequent re-insertion. On the other hand, and thanks to the same anti-friction quality of the inner face of the sleeve 3, the handgun will be protected against possible dents, bumps and scratches that may ensue when the dun rubs or hits the holster. Furthermore, the properties of the sleeve can be useful for preventing the occurrence of oxidations of the handgun.

There is than ensured a particularly effective performance, to be surely appreciated by the users, in comparison with known holsters.

The present invention is not limited to the above described and depicted embodiment but encompasses variants and modification within the scope of the appended claims. In particular, the provision of a recess is not strictly necessary, and the inserted sleeve may result in a local increase to the normal thickness of the shell. Even more generally speaking, the sleeve, that could also cover the whole inner face of the shell and not only three consecutive sides as in the present example, can be made integral with the shell e.g. by means of co-molding productive processes.

The invention claimed is:

1. A handgun holster comprising:

a shell made of a rigid material, an inner shell face defined by said shell, said shell having an elongated shape according to a longitudinal direction starting from a handgun insertion end, wherein said inner face is at least partially covered by an inner sleeve comprising an anti-friction, self-lubricating material, wherein said inner sleeve is releasably accommodated within said shell, wherein a recess is formed over a part of said inner shell face and houses said inner sleeve, wherein said shell comprises two side walls mutually joined by a rear rib and by a front rib, said front rib being adapted to face a barrel of said handgun, said inner sleeve having an elongated gutter-like body with a substantially C-shaped cross section, said recess being formed over said front rib and over portions of said side walls adjacent with said front rib, and wherein said recess is formed as a negative impression of the shape and side of said sleeve, whereby the sleeve is adapted to restore the rib and wall thickness the shell would in theory have without the recess.

2. The holster according to claim 1, wherein said inner sleeve of said anti-friction, self-lubricating material is a polymeric material selected from the group consisting of polyoxymethylene and polytetrafluoroethylene.

3. The holster according to claim 1, wherein said recess has a top end adjacent with said handgun insertion shell end, and a bottom end spaced apart with respect to said handgun insertion shell end, said recess bottom end being in the form of a step defining a sleeve-stop bottom face, a groove being cut into said bottom face for locking a correspondent bottom end lip of said sleeve, whereby the engagement between said groove and said lip prevents said sleeve from displacing in a plane orthogonal with the longitudinal direction.

4. The holster according to claim 3, wherein a top end of said sleeve comprises a sideways protruding rim adapted to abut against said top end of said recess for stopping the sleeve.

5. The holster according to claim 4, wherein said top end of said recess forms a step that accommodates said rim.

6. The holster according to claim 1, wherein said sleeve and said shell, in said recess, comprise respective holes that by mutual correspondence form a seat for engagement of a locking peg.

7. The holster according to claim 6, wherein said seat is arranged close to the handgun insertion end of the shell, in said front rib.

8. The holster according to claim 7, wherein said seat is arranged in correspondence with mutually matching bulging portions of said front rib and of said sleeve, the engagement between the bulging portion offering a longitudinal stop action and a constraint against a rotation of the sleeve with respect to an axis along the longitudinal direction.

9. The holster according to claim 1, wherein said inner sleeve is completely made of said anti-friction, self-lubricating material.

10. The holster according to claim 1, wherein said inner sleeve comprises a surface treatment or liner made of said anti-friction, self-lubricating material.

* * * * *